US005730315A

United States Patent [19]

Richoux

[11] Patent Number: 5,730,315

[45] Date of Patent: Mar. 24, 1998

[54] DRUM

[76] Inventor: Jimmy A. Richoux, P.O. Drawer 68, Harvey, La. 70058

[21] Appl. No.: 621,011

[22] Filed: Mar. 22, 1996

[51] Int. Cl.[6] ..... B65D 51/26

[52] U.S. Cl. ..... 220/672; 220/DIG. 1

[58] Field of Search ..... 220/672, 4.04, 220/DIG. 1

[56] References Cited

U.S. PATENT DOCUMENTS

| | | | |
|---|---|---|---|
| 291,004 | 12/1883 | Rosensteel | 220/672 |
| 1,649,292 | 11/1927 | Draper | 220/672 |
| 2,103,677 | 12/1937 | Kline et al. | 220/DIG. 1 X |
| 3,268,109 | 8/1966 | Coppens | 220/672 |
| 4,781,301 | 11/1988 | LeBret et al. | 220/DIG. 1 X |

*Primary Examiner*—Steven M. Pollard
*Attorney, Agent, or Firm*—Keaty Patent Firm

[57] ABSTRACT

The invention relates to drum containers provided with one or more rolling hoops. The drum has a continuous vertical side wall provided with one or more reinforced portions. Each of the reinforced portions is provided with an outwardly convex rolling hoop located between a pair of inwardly concave annular grooves formed in the side wall of the drum. The vertical dimensions of the grooves are at least twice the size of the grooves' depth, while the vertical dimension of the rolling hoop is at least twice the horizontal projection by which the rolling hoop extends outwardly from the side wall.

8 Claims, 1 Drawing Sheet

DRUM

BACKGROUND OF THE INVENTION

The present invention relates to storage containers, and more particularly to a drum suitable for storage and transportation of liquids.

Conventionally, some drum bodies are constructed from non-corrosive metals, with the wall of the drum having a thickness of about 5 mm and larger. Such drums have strong walls which are not readily susceptible to deformation caused by exterior forces acting on the drum, as well as pressures created inside of the drum. However, such drums are relatively expensive and heavy, two factors which are taken into consideration when the liquids have to be transported a short distance or stored for a short time.

For short term storage and transportation drums are used. These temporary drum containers are usually constructed with wall thickness of 1 mm or less. Reduced wall thickness, naturally, leads to increased susceptibility of the drum body to deformation from exterior forces, for example when the drums are stacked vertically on top of each other. An additional problem is created when the liquid placed in a drum is in a hot liquid state. The liquid cools after the drum has been closed. At such time, the pressure inside the drum decreases, creating a vacuum in the drum which often leads to a deformation of the drum wall.

In accordance with practices conventional drum walls are made with two rolling hoops, which are generally outwardly extending annular protrusions formed about the outer circumference of the drum. The rolling hoops are vertically spaced from each other along the length of the drum wall. If the rolling hoops are shaped at an acute angle, the vertical strength of the wall is diminished which adversely effects the adaptability of the drums to vertical stacking.

It was also noted that standard rolling hoops extend outwardly from the cylindrical wall of the drum to a distance inhibits efficient use of space during transportation of a plurality of drums in standard shipping containers, such as for example ISO containers. U.S. Pat. No. 4,781,301 issued on Nov. 1, 1988 to Le Bret, et al provides a solution to the problem of fitting a plurality of drums into a standard ISO container. In accordance with the '301 patent, the radial spatial dimension of the drum is reduced, while the mechanical and rolling properties of the drum are not effected. In accordance with that patent, the drum body is provided with a plurality of corrugations which comprise alternating peaks and troughs, with the corrugations generally offset towards the center of the drum. Rolling hoops are formed by outwardly expanding the drum body from the center of the drum along a zone of a plurality of corrugations. The rolling hoop has an outer diameter greater than the diameter of the cylindrical wall of the drum.

The drawback of the drum body in accordance with the '301 patent is associated with a provision of corrugations over a large portion of the drum wall. The manufacture of such drums is complicated as it involves creation of multiple corrugation zones. Additionally, the angle formed by the rolling hoops of the drum is greater than the angle of the rest of the corrugations, since the rolling hoops are formed by expanding one of the peaks outwardly. Such a construction greatly weakens the mechanical strength of the wall relative to the vertical component of forces acting on the drum during stacking. The corrugated drums are of less value to companies that specialize in reconditioning of the drums because the corrugated drams are very difficult to clean and are usually manufactured from a metal having lighter gauge.

Additionally, the corrugations make it impossible for manufacturers to place a product label on the side of the drum or to silk screen.

The present invention contemplates elimination of drawbacks associated with the prior art and provision of a drum container which provides for a wall strong enough to withstand vertical forces acting on the drum and resist deformation due to vacuum created inside of the drum, while at the same time, affording an easy and inexpensive manufacture of the drums.

SUMMARY OF THE INVENTION

It is, therefore, an object of the present invention to provide a drum container suitable for transportation and storage of liquids.

It is another object of the present invention to provide a drum having rolling hoops formed on the outer circumference of the drum to allow rolling of the container, along a surface when necessary.

It is a further object of the present to provide a drum container having cylindrical walls capable of withstanding vertical forces acting on the drum during stacking without any substantial deformation of the drum wall.

It is still a further object of the present invention to provide a drum container which is easy and inexpensive to manufacture.

These and other objects of the present invention are achieved through a provision of a drum container which is formed by a cylindrical body having a continuous vertical side wall. The wall is provided with one or more reinforced portions, each of such portions comprising an outwardly convex rolling hoop which extends a distance from the vertical side wall. The rolling hoop is positioned between a pair of inwardly concave annular grooves, with the diameter of that part of the drum which has the annular grooves being smaller than the diameter of the cylindrical outer wall. Each of the grooves has a width, or a vertical dimension which is at least twice the depth, or the radius of the groove. The radius of the rolling hoop is substantially equal to the radius of each of the grooves, while the vertical dimension of the rolling hoop is substantially equal to the vertical dimension of each of the grooves.

The portion of the side wall where the reinforced portion is located resembles a harmonic wave, with the curvature of the concave groove being identical to the curvature of the outwardly extending rolling hoop. With two reinforced portions provided in a spaced-apart relationship along the vertical length of the side wall, the strength of the drum wall is substantially increased, while the spatial dimension of the drum is of a magnitude allowing convenient positioning of the drums side-by-side within a standard shipping container. The reinforced portions provide sufficient resistance to deformation of the drum wall during vertical stacking of the drums or when vacuum is created inside the drum body.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 2:
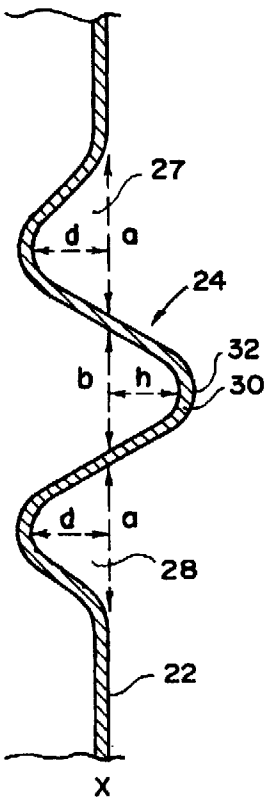
FIG. 2 is a detail cross-sectional view of a drum wall showing the annular grooves and the rolling hoop of the drum container in accordance with the present invention.
Figure 1:
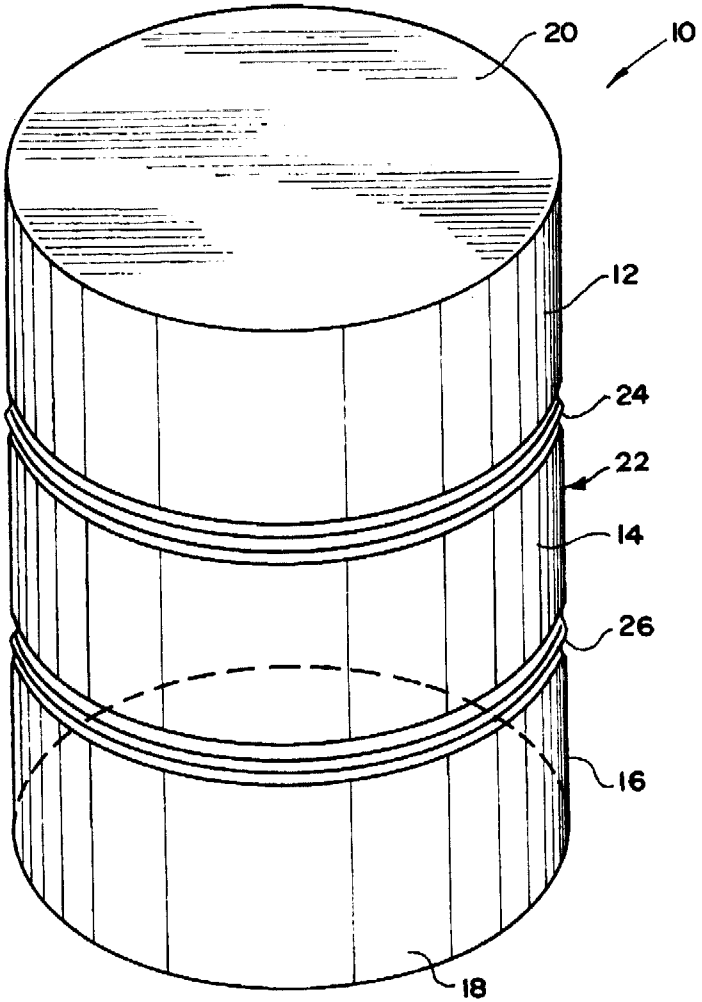
FIG. 1 is a perspective view of a drum in accordance with the present invention.

Referring to the drawings in more detail, numeral 10 designates the drum container in accordance with the present invention. The drum 10 comprises an upper portion 12, a middle portion 14, and a lower portion 16. The drum, conventionally, has a closed bottom 18 and a normally open top 20 which is fitted with a removable cover (not shown) to allow placing of liquids inside the drum 10. As can be seen in the drawing, the portions 12, 14 and 16 present a substantially smooth exterior surface of an outer cylindrical wall 22 of the container 10.

The wall 22 is provided with an upper reinforced portion 24 and a lower reinforced portion 26. The reinforced portions 24, 26 are vertically spaced from each other and are separated by the middle portion 14, so as to provide increased strength to the drum wall 22.

Turning now to FIG. 2, a reinforced portion 24 is shown in more detail. The reinforced portion 24 comprises an upper annular groove, or trough 27, and a lower annular groove, or trough 28. A rolling hoop 30 is formed between the grooves 27 and 28 and extends outwardly from the vertical wall 22 of the drum body 10. The shape of the grooves 27, 28 and of the rolling hoop 30 resembles a harmonic wave, with the depth of each of the grooves "d" being substantially equal to the height, or horizontal extension "h" of the rolling hoop 30.

The grooves 27 and 28 extend inwardly towards the center of the drum body in relationship to the axis "x" of the cylindrical wall 22. The rolling hoop 30 extends outwardly from the exterior surface of the wall 22 to a distance "h" which is not substantially greater than the depth "d" of each of the grooves 27 and 28.

Each groove 27 and 28 has a discrete width, or a vertical dimension "a" which is substantially equal to the width or a vertical dimension "b" of the rolling hoop 30. It is also important to note that the vertical dimensions of the grooves 27 and 28, as well as of the rolling hoop 30 are at least twice as great as the radial depth "d" of the trough 27, 28 and the height "h" of the rolling hoop 30.

It was observed that the above described mutual relationship between the annular grooves 27, 28, as well as the rolling hoop 30 allows provision of a drum structure which is strong even when the wall thickness is reduced to about 1 mm. The peak 32 of the rolling hoop 30 is curved, which further reduces the danger of any substantial deformation of the drum wall during vertical stacking of the drums.

While only reinforced portion 24 was described in detail, it will be understood by those skilled in the art that reinforced portion 26 is substantially identical to the reinforced portion 24 in all aspects. The reinforced portion 26 is similarly provided with a pair of vertically spaced annular grooves and a rolling hoop formed therebetween, with a rolling hoop extending outwardly from an exterior surface of the drum wall 22.

The combination of the annular grooves the inner concave surfaces of which have a diameter smaller than the outside diameter of the drum wall 22, with the outwardly convex rolling hoop having an outside diameter greater than the outside diameter of the drum wall 22 allows for creation of a strong drum body which can withstand forces acting on the drum wall during transportation of liquids.

Additionally, the drum wall constructed in accordance with the present invention resists deformation due to vacuum created in the drum when the drum is filled with a liquid in a hot liquid state. Further, the spatial dimensions of the drum, with the rolling hoop 30 not extending outwardly to a degree substantially greater than the depth of the grooves allows for convenient placing of the drums side-by-side in a shipping container. As a result, the space of standard containers where a plurality of such drums is usually transported can be efficiently utilized.

Many changes and modifications can be made in the design of the present invention without departing from the spirit thereof. I, therefore, pray that my rights to the present invention be limited only by the scope of the appended claims.

I claim:

1. A container comprising:

a generally cylindrical body having a continuous side wall, said wall being provided with at least one reinforced portion which comprises a single rolling hoop extending outwardly from an outer surface of said wall, said rolling hoop being positioned between a pair of annular grooves formed in adjacent portions of said side wall, each of said grooves having a discrete width which is at least twice the depth of the groove; and wherein said rolling hoop has a radius substantially equal to the radius of each of said grooves.

2. The container of claim 1, wherein each of said grooves is defined by an inwardly concave part of said side wall.

3. The container of claim 1, wherein said rolling hoop is defined by an outwardly convex part of said side wall.

4. The container of claim 1, wherein said rolling hoop has a discrete width which is at least twice a distance of an outward extension of the rolling hoop from said side wall.

5. The container of claim 1, wherein said side wall is provided with at least two spaced-apart reinforced portions.

6. A drum, comprising:

a generally cylindrical body having a continuous vertical side wall, said side wall being provided with a smooth outer surface and at least two vertically spaced-apart reinforced portions, each of said reinforced portions comprising a single outwardly convex rolling hoop which extends outwardly from said outer surface and is positioned between a pair of annular grooves formed in adjacent portions of said side wall, each of said grooves having a discrete width which is twice the depth of the groove and wherein said rolling hoop has a discrete vertical dimension which is twice the distance of a horizontal projection by which the rolling hoop extends outwardly from said outer surface of the side wall wherein said rolling hoop has a radius which is substantially equal to the radius of each of said concave parts.

7. The drum of claim 6, wherein each of said grooves is formed by an inwardly concave part of said side wall, and wherein each of said grooves has a discrete width which is at least twice the radius of said concave part.

8. A drum container, comprising:

a hollow body having a cylindrical continuous vertical side wall, said wall being provided with a smooth outer surface and at least two vertically spaced-apart reinforced portions, each of said reinforced portions comprising a single outwardly convex rolling hoop which extends outwardly from the outer surface and is positioned between a pair of annular inwardly concave grooves formed in adjacent portions of the side wall, said rolling hoop having a discrete vertical dimension which is at least twice the distance of a horizontal projection by which the rolling hoop extends outwardly from the outer surface of the side wall, and wherein each of said grooves has a discrete width which is at least twice the depth of the groove wherein said rolling hoop has a radius which is substantially equal to the radius of each of said concave grooves.

* * * * *